US008156862B2

(12) United States Patent
Mullins et al.

(10) Patent No.: US 8,156,862 B2
(45) **Date of Patent: *Apr. 17, 2012**

(54) METHOD AND APPARATUS FOR FORMING A BALE HAVING SUBSTANTIALLY FLAT UPPER AND LOWER SURFACES

(75) Inventors: Charles Duane Mullins, Kingsport, TN (US); Charles Clifton Sanders, Gray, TN (US); Kenneth Wayne Martin, Kingsport, TN (US); David Weldon Thompson, Kingsport, TN (US); Paul Ross Hammes, Kingsport, TN (US); Kenneth Alan Lewis, Kingsport, TN (US); Lori Ballard Larkins, Kingsport, TN (US)

(73) Assignee: Eastman Chemical Company, Kingsport, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/764,601

(22) Filed: Apr. 21, 2010

(65) Prior Publication Data

US 2010/0199864 A1 Aug. 12, 2010

Related U.S. Application Data

(63) Continuation of application No. 11/116,477, filed on Apr. 28, 2005, now Pat. No. 7,730,832.

(51) Int. Cl.
*B65B 13/02* (2006.01)

(52) U.S. Cl. ..... 100/42; 100/3; 100/5; 100/29

(58) Field of Classification Search ..... 100/2, 3, 100/5, 6, 29, 35, 42

See application file for complete search history.

(56) References Cited

U.S. PATENT DOCUMENTS

| | | | |
|---|---|---|---|
| 159,378 | A | 2/1875 | Baldwin |
| 206,658 | A | 8/1878 | Blossom |
| 467,783 | A | 1/1892 | Sailor |
| 705,134 | A | 7/1902 | Pope et al. |
| 2,779,974 | A | 2/1957 | Billing et al. |
| 2,947,241 | A | 8/1960 | Guenther et al. |
| 2,947,242 | A | 8/1960 | Guenther et al. |
| 3,063,363 | A | 11/1962 | Lamb |
| 3,351,992 | A | 11/1967 | Carter |
| 3,529,540 | A | 9/1970 | Ferris |
| 3,991,670 | A | 11/1976 | Stromberg |
| 4,092,912 | A | 6/1978 | Simich |

(Continued)

FOREIGN PATENT DOCUMENTS

CA 2 482 107 10/2003

(Continued)

OTHER PUBLICATIONS

Colin L. Browne, "The Design of Cigarettes," Hocchst Celanese Corporation, pp. 59-64, 1990.

(Continued)

*Primary Examiner* — Shelley Self
(74) *Attorney, Agent, or Firm* — Michael K. Carrier; Bernard J. Graves, Jr.

(57) ABSTRACT

An apparatus and method are described for forming a bale having substantially flat upper and lower surfaces. Also described is a bale having substantially flat upper and lower surfaces, which can be safely stacked vertically for transportation and storage purposes.

7 Claims, 9 Drawing Sheets

U.S. PATENT DOCUMENTS

| | | | | |
|---|---|---|---|---|
| 4,157,754 | A | 6/1979 | Bartsch et al. | |
| 4,162,603 | A | 7/1979 | Strümberg | |
| 4,324,176 | A | 4/1982 | McCormick | |
| 4,366,751 | A | 1/1983 | Spaller, Jr. | |
| 4,393,767 | A * | 7/1983 | Dutfield | 100/229 A |
| 4,577,752 | A | 3/1986 | Meredith, Jr. | |
| 4,746,011 | A | 5/1988 | McNair, Jr. et al. | |
| 4,910,855 | A | 3/1990 | Balarzs | |
| 5,131,210 | A | 7/1992 | Kiya | |
| 5,369,935 | A | 12/1994 | Lang et al. | |
| 5,695,486 | A | 12/1997 | Broughton et al. | |
| 5,701,723 | A | 12/1997 | Simpson | |
| 5,732,531 | A | 3/1998 | de Silva et al. | |
| 5,775,058 | A | 7/1998 | Hirschek | |
| 5,852,969 | A | 12/1998 | Anthony | |
| 6,158,194 | A | 12/2000 | Horn et al. | |
| 6,158,197 | A | 12/2000 | Mogard et al. | |
| 6,474,226 | B1 | 11/2002 | Sutton et al. | |
| 7,055,424 | B1 | 6/2006 | Bielli | |
| 7,306,093 | B2 | 12/2007 | McLaughlin et al. | |
| 7,424,850 | B2 | 9/2008 | Sanderson et al. | |
| 7,487,720 | B2 | 2/2009 | Bundren et al. | |
| 7,730,832 | B2 * | 6/2010 | Mullins et al. | 100/3 |
| 2004/1015965 | | 8/2004 | McLaughlin et al. | |
| 2005/0161358 | A1 | 7/2005 | Kern | |
| 2006/0243142 | A1 | 11/2006 | Mullins et al. | |
| 2006/0249406 | A1 | 11/2006 | Sanderson et al. | |

FOREIGN PATENT DOCUMENTS

| | | | |
|---|---|---|---|
| DE | 296 15 598 | U1 | 12/1996 |
| GB | 896 228 | | 5/1962 |
| JP | 2004-34062 | A | 2/2004 |
| WO | WO 02/32238 | A2 | 4/2002 |
| WO | WO 2006/121555 | A2 | 11/2006 |

OTHER PUBLICATIONS

Notification of Transmittal of the International Search Report and the Written Opinion of the International Searching Authority, or the Declaration date of mailing Aug. 9, 2006 received in International Application No. PCT/US2006/014868.

* cited by examiner

METHOD AND APPARATUS FOR FORMING A BALE HAVING SUBSTANTIALLY FLAT UPPER AND LOWER SURFACES

CROSS-REFERENCE TO RELATED APPLICATION

This application is a continuation of U.S. patent application Ser. No. 11/116,477 filed on Apr. 28, 2005, now U.S. Pat. No. 7,730,832, the disclosure of which is incorporated herein by reference in its entirety.

FIELD OF THE INVENTION

The present invention generally relates to a method and apparatus for forming a bale having substantially flat upper and lower surfaces. The bales produced according to the invention can be stacked vertically with reduced risk of falling over.

BACKGROUND OF THE INVENTION

Various types of compressible materials can be conventionally packaged into relatively large, discrete bales to facilitate the storage and transport of the materials. A plurality of the bales can be vertically arranged into stacks to facilitate transport and maximize storage space. When the compressible material is ready for use, the bales can be unpackaged and the material can be used for its intended application.

The compressible materials can be compressed prior to packaging in order to increase the density of the bales. In conventional baling processes, the fact that the material is in a compressed state typically leads to the formation of bales with significantly "crowned" upper and lower surfaces, i.e., the bales have significantly arched upper and lower surfaces as shown in FIG. 8. These significantly crowned upper and lower surfaces have an adverse effect on the stability of the aforementioned vertical bale stacks. FIG. 9 shows a vertical bale stack that is rendered unstable due to the significantly crowned surfaces of the conventional bales. For example, the vertical bale stacks formed from the conventional bales have a tendency to tip over and/or fall during routine handling, as can be seen from FIG. 10. The reduced stability of the vertical bale stacks can be a safety hazard at the worksite, and can substantially increase the amount of time and/or cost associated with the storage and transport of the bales.

SUMMARY OF THE INVENTION

In a first aspect, the invention provides an apparatus for forming a bale having substantially flat upper and lower surfaces, comprising:

(a) an upper platen comprising a protruding surface for compressing an upper surface of a compressible material, wherein the protruding surface has a shape that is effective for forming a substantially flat upper surface on the compressible material; and (b) a lower platen comprising a protruding surface for compressing a lower surface of the compressible material, wherein the protruding surface has a shape that is effective for forming a substantially flat lower surface on the compressible material.

In a second aspect, the invention provides a method of forming a bale having substantially flat upper and lower surfaces, comprising:

(a) providing a compressible material between the upper platen and the lower platen of the apparatus described above;

(b) compressing the material between the upper platen and the lower platen by adjusting the position of the upper platen and/or the lower platen; and (c) binding the compressible material with at least one elongated wrapping article to form a bale.

In a third aspect, the invention provides a bale suitable for stable arrangement in a vertical bale stack, comprising a compressed material bound by at least one wrapping article, wherein the bale has a substantially flat upper surface and a substantially flat lower surface.

DETAILED DESCRIPTION

Figure 1:
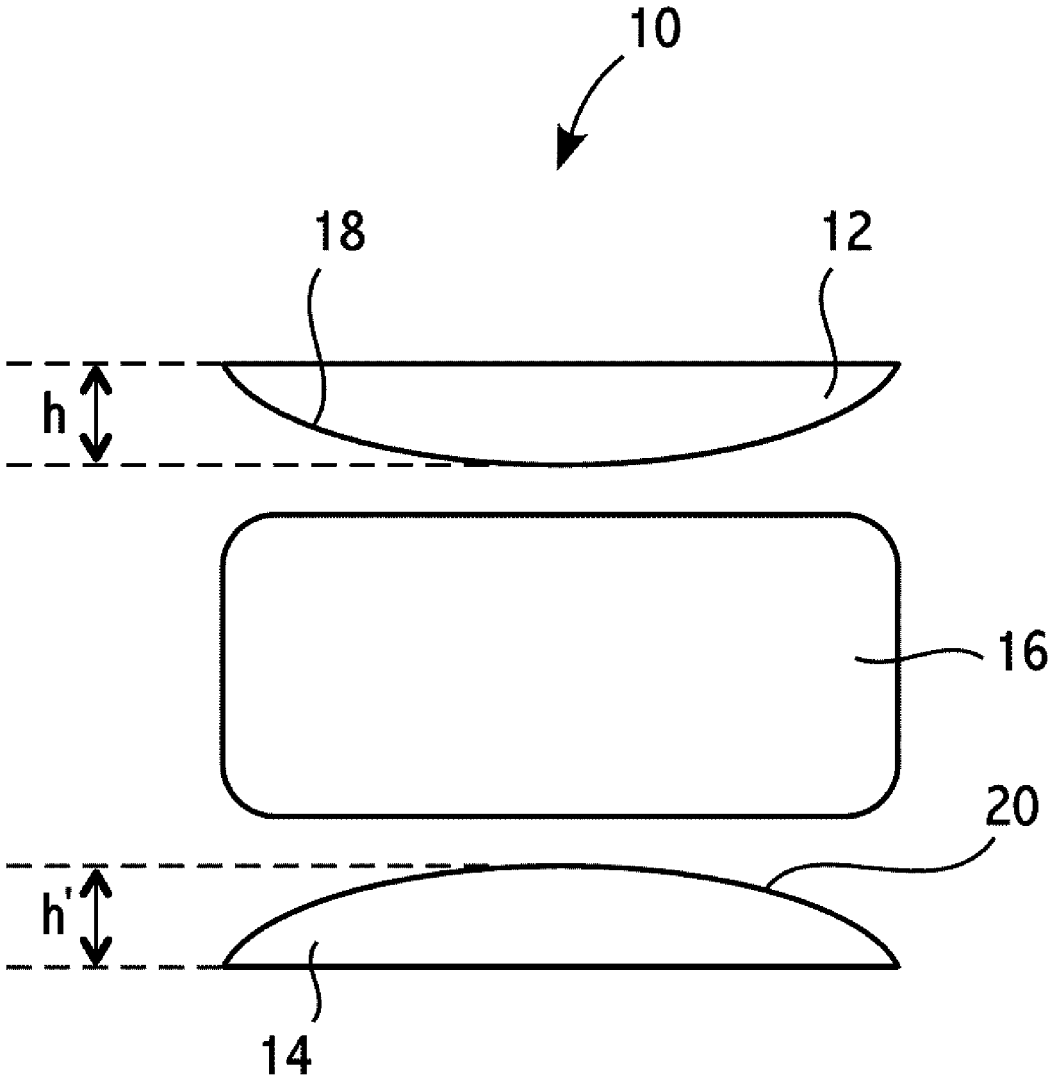
FIG. 1 is a side view of an exemplary apparatus for forming a bale, according to one aspect of the invention.
Figure 2A:
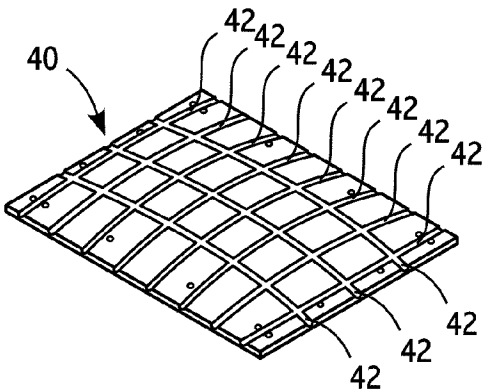
FIG. 2A is a perspective view of an exemplary platen for use in an apparatus for forming a bale, according to another aspect of the invention.
Figure 2B:
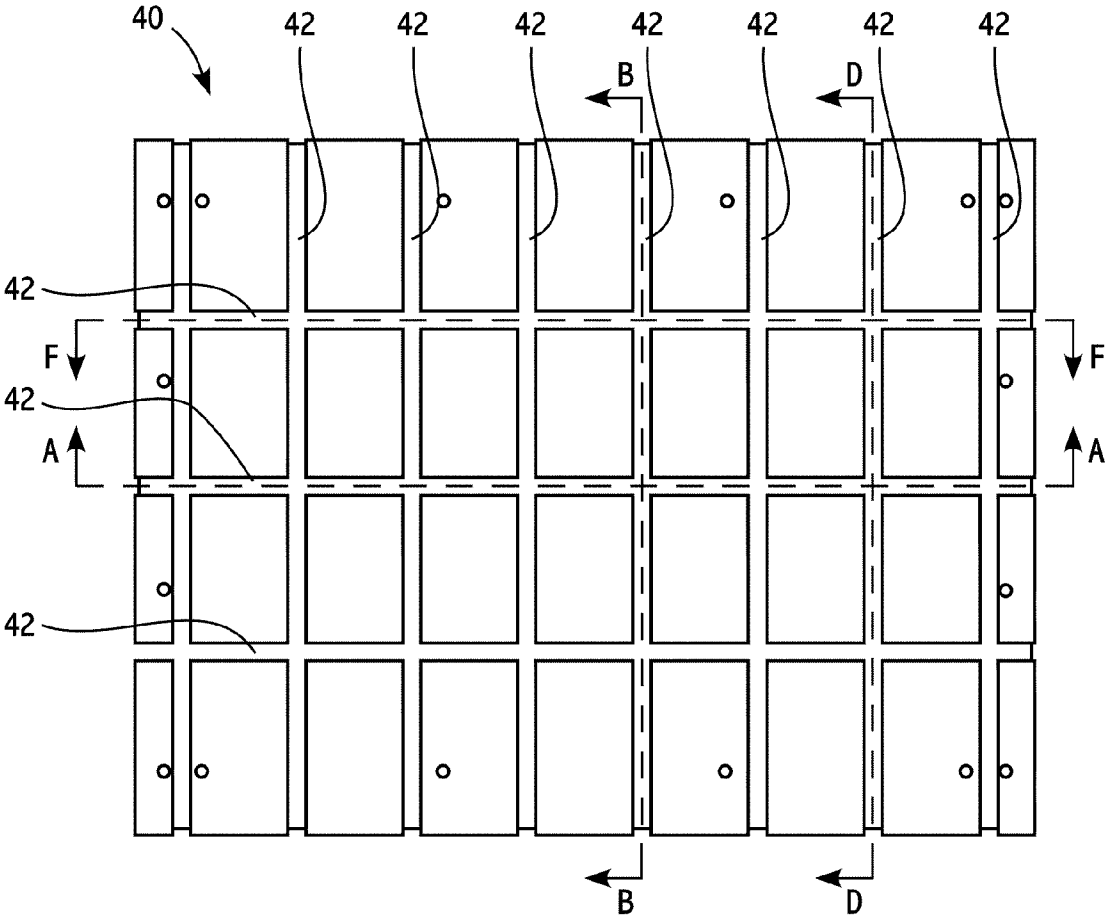
FIG. 2B is a top view of the exemplary platen shown in FIG. 2A.
Figure 2C:
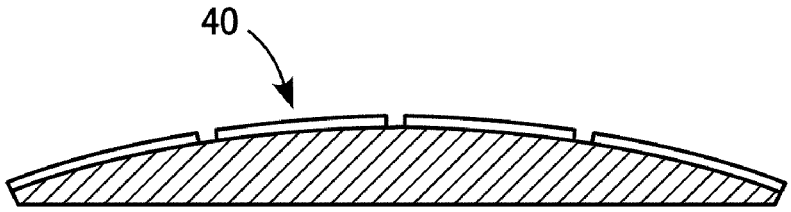
FIGS. 2C and 2D are cross-sectional profile views of the exemplary platen shown in FIG. 2A, taken along cross-sections B-B and D-D, respectively.
Figure 2D:
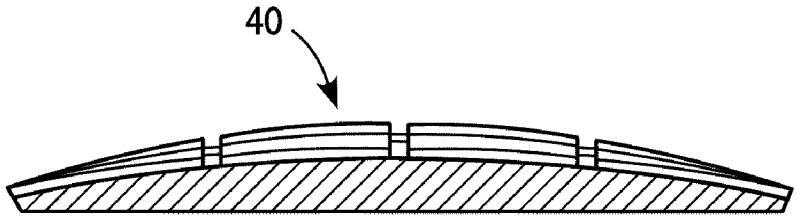
Figure 2E:
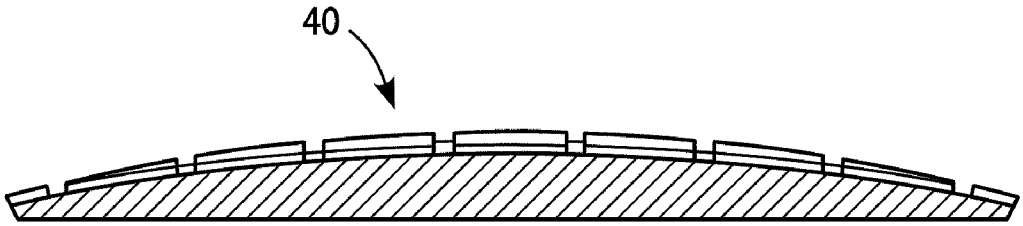
FIGS. 2E and 2F are cross-sectional profile views of the exemplary platen shown in FIG. 2A, taken along cross-sections A-A and F-F, respectively.
Figure 2F:
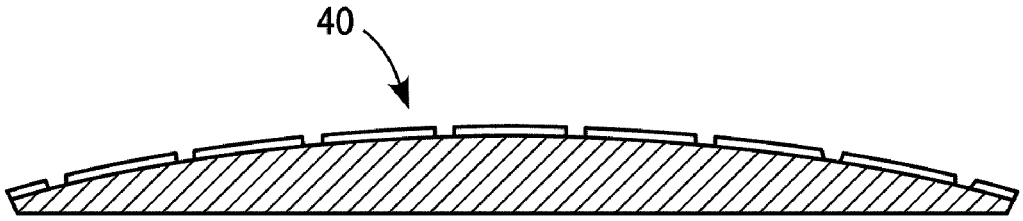

Referring to FIG. 1, an apparatus 10 for forming a bale includes opposing upper and lower platens 12 and 14, each having a protruding surface 18 and 20. A compressible material 16 can be positioned between the platens 12 and 14 and compressed therebetween. A bale can be formed by applying at least one wrapping article (not shown) around the compressible material 16 while the compressible material 16 is in a compressed condition. In an exemplary embodiment, the apparatus 10 can be capable of forming a bale having substantially flat upper and lower surfaces, which in turn can improve the stability of a vertical stack of such bales arranged one on top of another. The formation of substantially flat surfaces on both the upper and lower surfaces of the bale surprisingly and unexpectedly improves stability of the vertical bale stacks.

Each of the upper and lower platens 12 and 14 of the apparatus 10 includes a protruding surface 18 and 20 for compressing the compressible material 16. The protruding surface 20 of the lower platen 14 protrudes upwards towards the compressible material 16, and the protruding surface 18 of the upper platen 12 protrudes downwards towards the compressible material 16.

The shape of the protruding surfaces 18 and 20 can enable formation of substantially flat upper and lower surfaces on the compressible material 16, respectively, when the platens 12 and 14 are pressed onto the compressible material 16 and thereafter released. For example, as a result of employing the apparatus 10, the upper and lower surfaces of the compressible material 16 remain substantially flat after the compressible material 16 is bound with at least one wrapping article, and after the platens 12 and 14 are removed from being in contact with the bale.

In an exemplary embodiment, the method and apparatus can be effective for forming a bale having substantially flat upper and lower surfaces while maintaining a relatively high density of the bale. For example, a bale density can be achieved that is comparable or greater to the density of conventional bales, without the problem of significantly crowned upper and lower surfaces that conventionally result from forming a high density bale. This can be achieved by employing the method and apparatus which includes the use of the protruding surfaces 18 and 20 of the platens 12 and 14.

The term "substantially flat" as used herein to describe surfaces of the compressible material 16 refers to a surface that enables the bales to be vertically stacked in a stable manner, i.e., without having the tendency to tip over or fall when subject to typical forces or movements associated with the handling, transport, and storage of the bales.

A substantially flat surface can include a flat surface having various surface characteristics that do not significantly affect the overall stability of the bale when vertically stacked. For example, the surface characteristics can be formed as a result of slots and/or recessed areas disposed on the upper and lower platens 12 and 14, such as those made by one or more wrapping articles used to bind the bale. In addition, the substantially flat surfaces can have a slight curvature as long as such curvature does not cause the bales to be unstable when vertically stacked. The substantially flat surfaces of the bales can have defined or rounded edges.

The particular shape of the protruding surfaces 18 and 20 which enables formation of substantially flat upper and lower surfaces on the compressible material 16, is not particularly limited. The shape of the protruding surfaces 18 and 20 can be optimized depending on the parameters of the specific application, for example, the type and desired density of the compressible material, and the desired dimensions of the bale. For example, the protruding surfaces 18 and 20 can have a convex shape such as an ellipsoidal or spherical-like shape, or a polyhedral shape such as a tetrahedral or pyramid-like shape. The protruding surfaces 18 and 20 can have a curved cross-sectional profile or a straight linear cross-sectional profile in the x-axis and the y-axis directions of the platen.

The maximum height values of the protruding surfaces are shown as h and h' in FIG. 1, and represent the maximum distance that the surface protrudes from the base of the platen, measured in the direction normal to the base of the platen. The maximum height values h and h' of the platens can be selected depending on various factors including, for example, the type of material and/or the density of the material that is being compressed. For example, for a bale of material such as cellulose acetate filter tow, the maximum height values h and h' can be from about 1.5 to about 5 inches for a bale having a height from about 12 to about 60 inches, or from about 1.5 to about 3 inches for a bale having an overall height from about 12 to about 50 inches The maximum height of the protruding surface can be disposed at least at the center of the platen. The maximum height can occur in a very small area of the protruding surface, or can constitute a larger, plateau-like surface.

The circumferential shape of the platens 12 and 14 is not particularly limited, and can depend on, for example, the desired dimensions of the bale. For example, the platens 12 and 14 can have a rectangular or square circumferential shape. The length of the platens 12 and 14 can be from about 24 to about 49 inches, and the width of the platens 12 and 14 can be from about 32 to about 52 inches. Similarly, the ratio of the length to the width may vary, for example, from about 0.5 to 1 to about 1.5 to 1.

FIGS. 2 to 4 show exemplary platens 40, 50, and 60, respectively, which are suitable for use as either or both of the upper and lower platens of the apparatus. For example, FIGS. 2A and 2B show an exemplary platen 40 having a rectangular circumferential shape and a convex protruding surface. As shown in FIGS. 2C and 2D, the platen 40 has a curved cross-sectional profile in the y-axis direction. FIGS. 2E and 2F show curved cross-sectional profiles of the platen 40 in the x-axis direction.

Figure 3A:
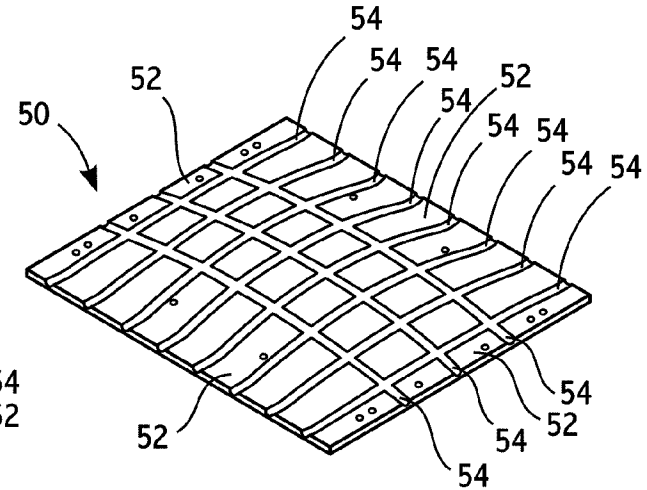
FIG. 3A is a perspective view of an exemplary platen for use in an apparatus for forming a bale, according to another aspect of the invention.
Figure 3B:
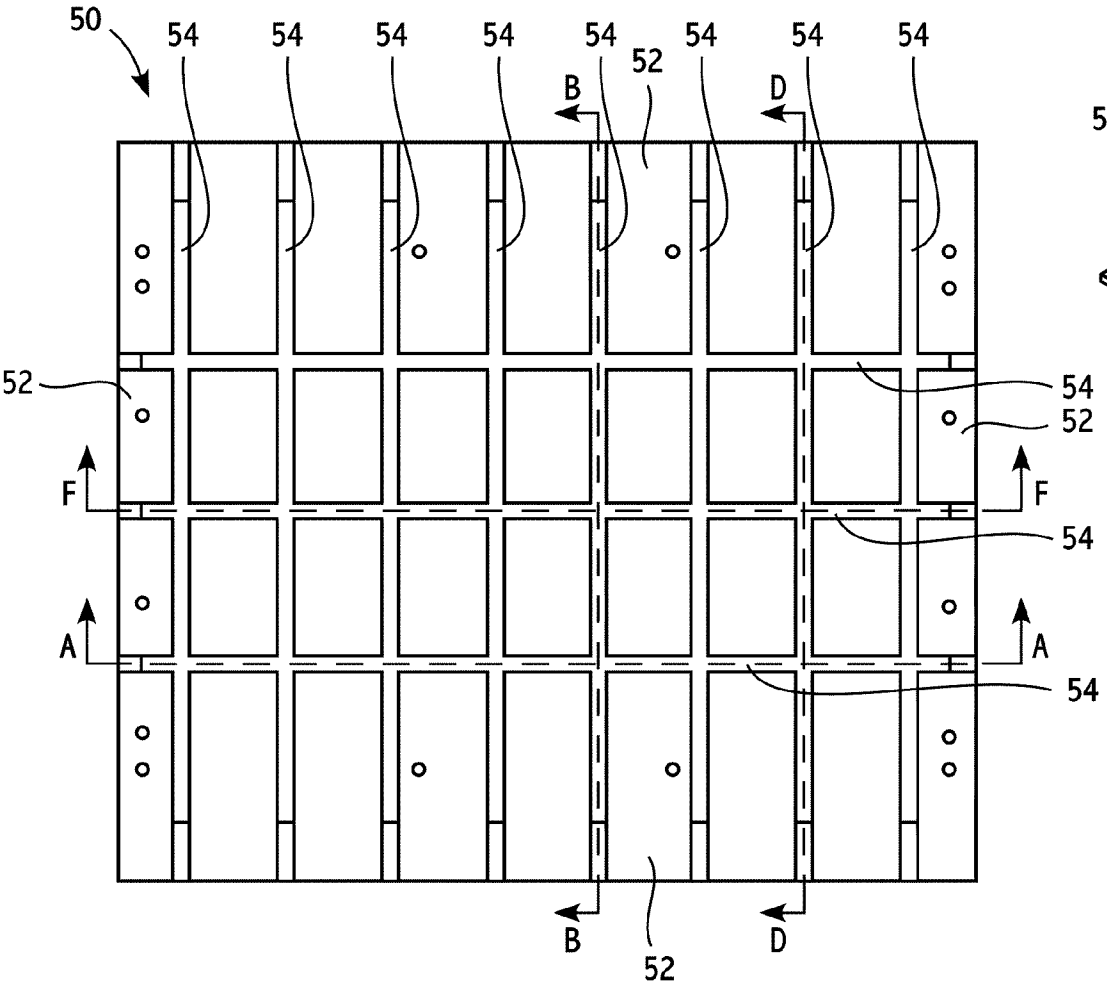
FIG. 3B is a top view of the exemplary platen shown in FIG. 3A.
Figure 3C:
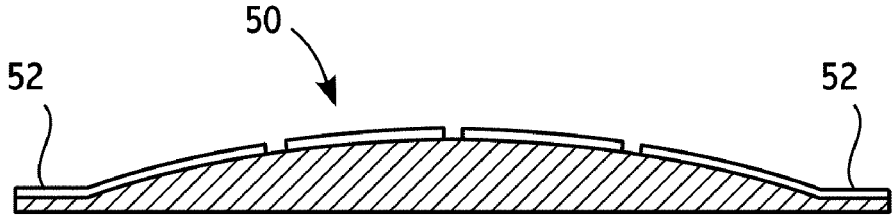
FIGS. 3C and 3D are cross-sectional profile views of the exemplary platen shown in FIG. 3A, taken along cross-sections B-B and D-D, respectively.
Figure 3D:
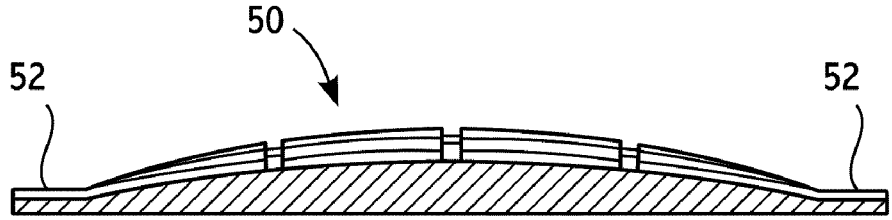
Figure 3E:
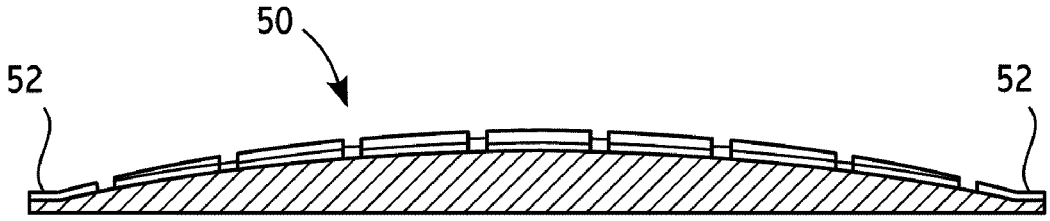
FIGS. 3E and 3F show cross-sectional profile views of the exemplary platen shown in FIG. 3A, taken along cross-sections A-A and F-F, respectively.
Figure 3F:
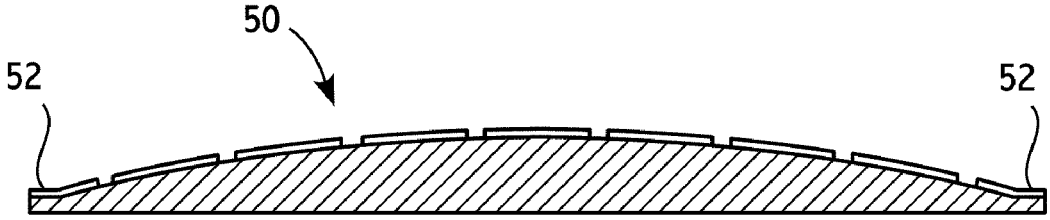

FIGS. 3A and 3B show an exemplary platen 50 having a rectangular circumferential shape and a convex protruding surface. FIGS. 3C and 3D show curved cross-sectional profiles of the platen 50 in the y-axis direction, and FIGS. 3E and 3F show curved cross-sectional profiles of the platen 50 in the x-axis direction. In this embodiment, the platen 50 includes a non-protruding surface 52 disposed along the circumference of the platen 54, which encompasses the protruding surface of the platen 50.

Figure 4A:
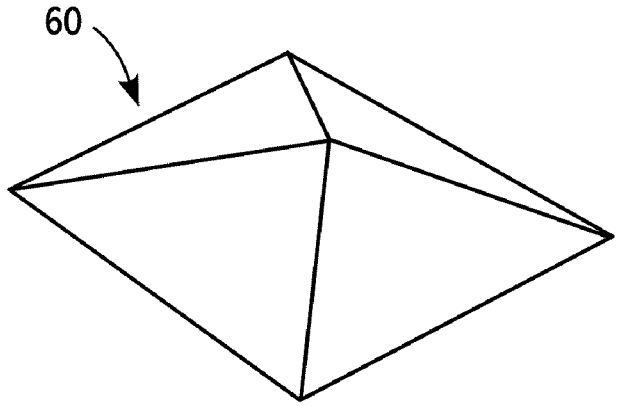
FIG. 4A is a perspective view of an exemplary platen for use in an apparatus for forming a bale, according to another aspect of the invention.
Figure 4B:
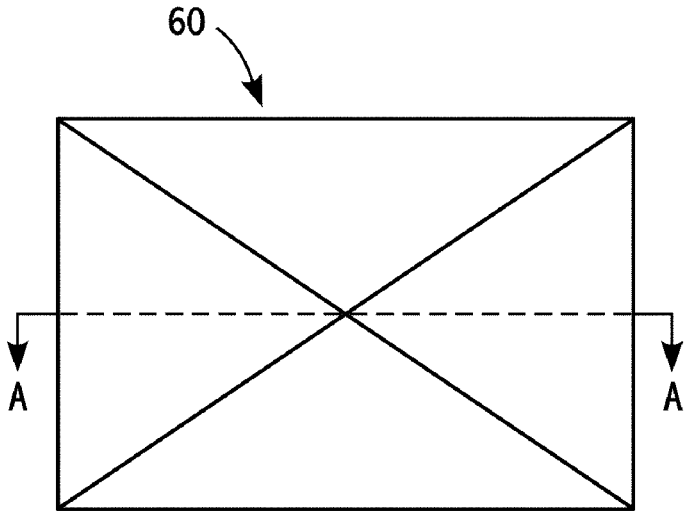
FIG. 4B is a top view of the exemplary platen shown in FIG. 4A.
Figure 4C:
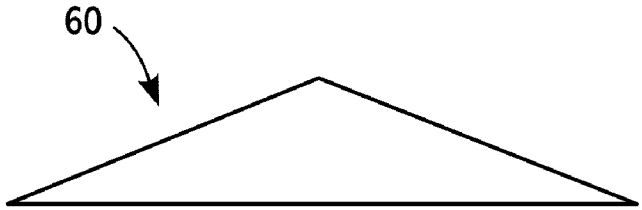
FIG. 4C is a cross-sectional profile view of the exemplary platen shown in FIG. 4A, taken along the cross-section A-A.
Figure 5:
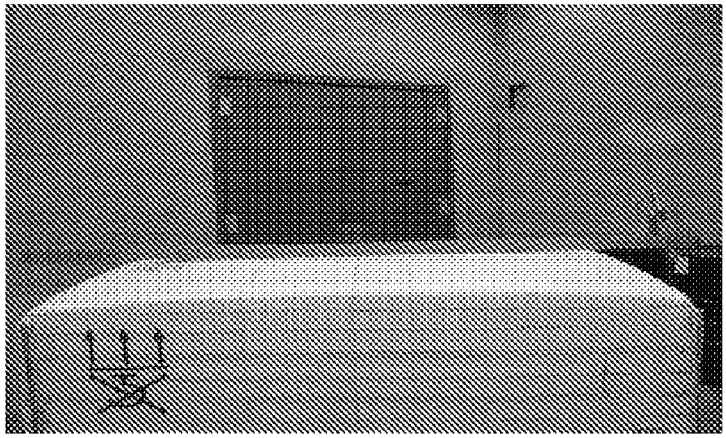
FIG. 5 is a photograph showing a substantially flat upper surface of an exemplary bale, according to another aspect of the invention.
Figure 6:
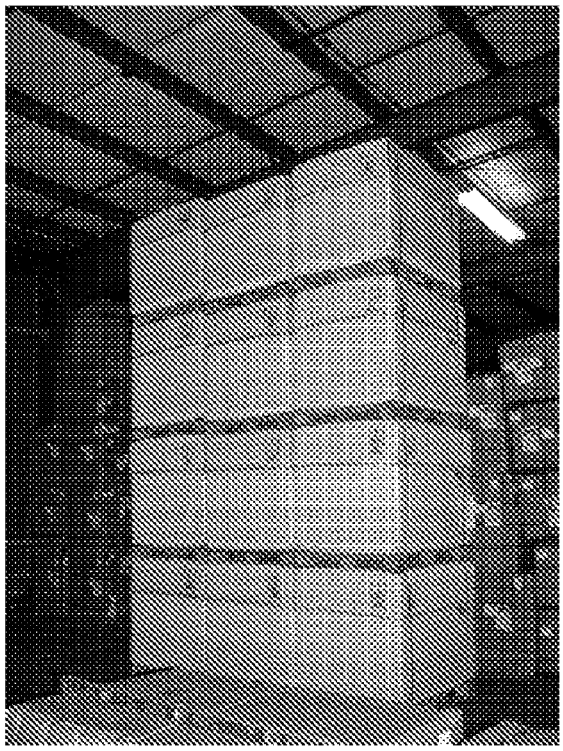
FIG. 6 is a photograph showing three vertical stacks of exemplary bales having substantially flat upper and lower surfaces, according to another aspect of the invention.
Figure 7:
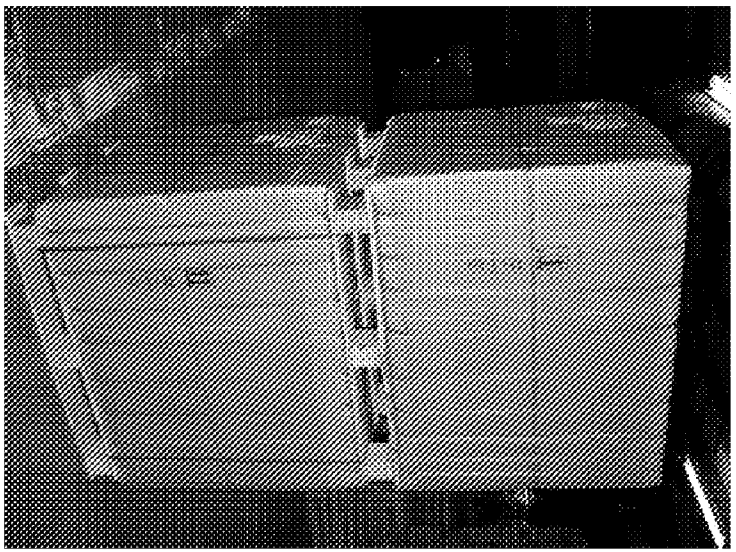
FIG. 7 is a photograph showing a vertical stack of two bales having substantially flat upper and lower surfaces, according to another aspect of the invention.
Figure 8:
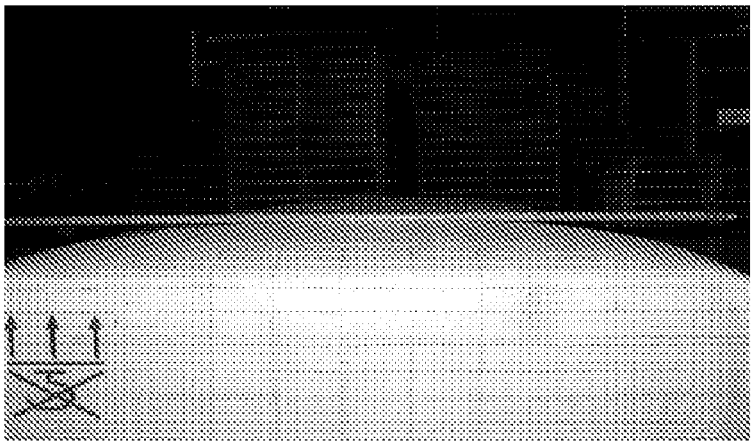
FIG. 8 is a photograph showing a significantly crowned upper surface of a conventional bale.
Figure 9:
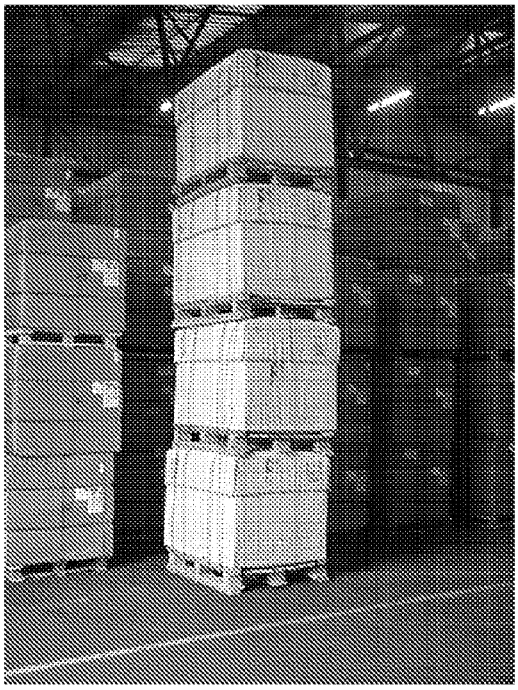
FIG. 9 is a photograph showing an unstable vertical stack of conventional bales.
Figure 10:
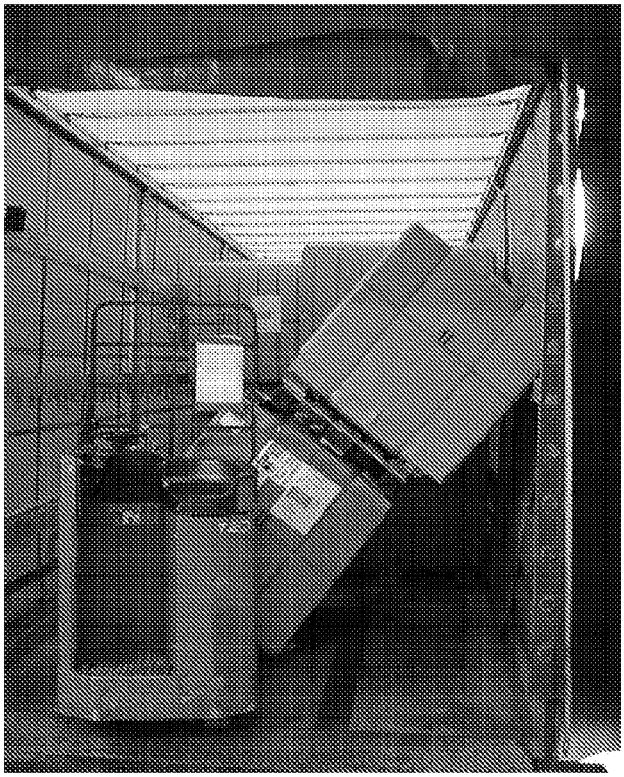
FIG. 10 is a photograph showing a vertical stack of conventional bales that has tipped over during handling of the stack.

FIGS. 4A to 4C show an exemplary platen 60 having a rectangular circumferential shape and a polyhedral protruding surface. As seen in FIG. 4C, the platen 60 has a relatively straight linear cross-sectional profile taken along the line A-A in FIG. 4B.

The protruding surfaces 18 and 20 can have disposed thereon a plurality of slots and/or recessed areas for imparting surface characteristics on the bale and/or for facilitating the baling process. For example, a plurality of slots 42 and 54 are disposed on the exemplary platens 40 and 50 depicted in FIGS. 2 and 3, respectively. The protruding surfaces 18 and 20 can be divided into a plurality of separate sections spaced with respect to each other to define therebetween a plurality of slots of predetermined width and depth. The plurality of slots can enable wrapping articles to be inserted therealong while the bale is held under compression.

A plurality of the platen sections can have a recessed area of a predetermined shape and size. The recessed areas can enable the surfaces of the bale to bulge into or be embossed into the recessed areas as the compressible material is being compressed by the apparatus, to form padded areas of the bale which can facilitate the eventual removal of the wrapping articles. The slots and/or recessed areas of the platens that can be employed are discussed in greater detail in U.S. Pat. No. 4,577,752, the content of which is herein incorporated by reference.

The platens 12 and 14 can be formed from any rigid material suitable for applying force and compressing the compressible material 16. For example, the platens 12 and 14 can be formed from metal, or from various types of plastics, including but not limited to a nylon, a polyester such as PET, or a polyolefin such as polyethylene or polypropylene, or even wood. The platens may be fabricated by any suitable process, such as by machining or molding.

The compressible material 16 can include any material that is capable of being compressed under the force applied by the upper and lower platens 12 and 14. For example, the compressible material 16 can include any material that is conventionally packaged in bales, and especially acetate tow that is suitable for use in manufacturing filters for cigarettes, and the like. Other compressible materials include, without limitation, tobacco, hay, cotton, staple fiber, or other man-made fibers such as those capable of being compressed with subsequent rebound upon release.

In an exemplary embodiment, a bale can be formed having substantially flat upper and lower surfaces while maintaining a relatively high density of the bale. For example, the compressible material 16 can be compressed to form a bale having a relatively high linear density, for example, from about 32 lbs/inch to about 36 lbs/inch The dimensions of the bales are not particularly limited, and can depend on the specific application. For example, the length of the bale can be from about 24 inches to about 49 inches, the width of the bale can be from about 32 inches to about 52 inches, and the height of the bale can be from about 12 inches to about 58 inches, or from about 28 inches to about 50 inches. The compressible material 16 can be at least partially covered by a protective covering such as, for example, a cardboard covering.

At least one wrapping article can be used to bind the compressible material 16 while in a compressed condition. In certain embodiments, a plurality of wrapping articles may be used. The wrapping article can have an elongated shape such as a wire, cable, or strap, and is preferably formed from a material that is capable of withstanding the normal wear and tear associated with the transport and storage of the bales. The wrapping article can include, for example, a plurality of metal straps, or plastic straps, or may use Velcro-type fasteners or the like. The wrapping article may be comprised of corrugated cardboard or woven polypropylene so as to cover a substantial portion of the surface of the bale, or the entire surface of the bale, and may be fastened with elongated straps or using Velcro-type fasteners. For example, the wrapping described in U.S. Pat. No. 5,732,531, incorporated by reference, may be used.

A method of forming a bale using the apparatus described above is also provided. The compressible material 16 can be compressed between the upper and lower platens 12 and 14, by adjusting the position of one or both of the platens 12 and 14. For example, the position of the upper and lower platens 12 and 14 can be adjusted to be in contact with and to press against the compressible material 16 using any suitable device for adjusting the position of the platens. For example, a motor (not shown) such as a hydraulic ram available from Hunger Hydraulic Group (Lohr am Main, Germany) can be used. Similarly, that described in U.S. Pat. No. 5,852,969 may be used, as may be any other suitable apparatus known in the art.

Alternatively, one of the platens can be in a fixed position, while the other platen is repositionable in the manner discussed above.

The upper and lower platens 12 and 14 can compress the compressible material 16 under conditions that are effective to impart substantially flat upper and lower surfaces thereon. For example, the platens 12 and 14 can compress the material 16 for from about 10 minutes to about 30 minutes or more. In a preferred embodiment, the platens may initially compress the material over a time period of up to about 10 minutes, after which the bale may be retained in the apparatus up to an additional 20 minutes or more.

The compressible material 16 can be placed in a rigid enclosure (not shown) while being compressed between the platens 12 and 14. The enclosure can include an upper opening enabling contact between the upper platen 12 and the compressible material 16, and a lower opening enabling contact between the lower platen 14 and the compressible material 16. When the platens 12 and 14 compress the compressible material 16, the sidewalls of the enclosure can provide lateral reinforcement to reduce or inhibit lateral expansion of the compressible material 16.

EXAMPLES

Exemplary bales of cellulose acetate fibers were formed in accordance with the invention, using a baling apparatus which employs convex platens with a maximum height of 3 inches (Inventive Examples 1 and 2). The numbers given as averages are the averages based on the measurements of at least 100 bales. Bales of cellulose acetate fibers were also formed in accordance with conventional processes, using a baling apparatus having conventional, flat platens (Comparative Examples 1 to 4). The flatness of the exemplary bales was compared, and the results as well as various parameters of the baling process are shown in Table 1:

TABLE 1

| | Package type | Platen shape and height | Press Cycle | Regain | Average weight | Average crown height |
|---|---|---|---|---|---|---|
| Comparative Example 1 | Reusable | Flat | 10 minute single | 10% | 507 kg | 2.5 inches |
| Comparative Example 2 | Reusable | Flat | 10 minute double | 0% | 705 kg | 3 inches |
| Comparative Example 3 | Cardboard | Flat | 10 minute single | 10% | 540 kg | 2.5 inches |

TABLE 1-continued

| | Package type | Platen shape and height | Press Cycle | Regain | Average weight | Average crown height |
|---|---|---|---|---|---|---|
| Comparative Example 4 | Cardboard | Flat | 10 minute double | 0% | 614 kg | 3 inches |
| Inventive Example 1 | Reusable | Convex, 3 inch | 20 minute single | 0% | 601 kg | 0.25 inch |
| Inventive Example 2 | Cardboard | Convex, 3 inch | 10 minute single | 0% | 540 kg | 0.25 inch |

The term "package type" refers to the outer covering of the bale. The reusable covering or wrapping is woven polypropylene with Velcro-type fasteners, and the cardboard is corrugated cardboard. The term "press cycle" means the time during which the bale is compressed.

The above embodiments are intended to serve as illustrations of the present invention. One of ordinary skill in the art should understand and appreciate that specific details of any particular embodiment may be different and will depend upon the location and needs of the system under consideration. All such layouts, schematic alternatives, and embodiments capable of achieving the present invention are considered to be within the capabilities of a person having skill in the art and thus within the scope of the present invention.

While the apparatuses and methods have been described in detail, it will be apparent to those of skill in the art that variations may be applied to the apparatuses and methods described herein without departing from the concept and scope of the invention. All such similar substitutes and modifications apparent to those skilled in the art are deemed to be within the scope and concept of the invention as it is set out in the following claims.

We claim:

1. A method of forming a bale comprising a compressible cellulose acetate and having substantially flat upper and lower surfaces, comprising:

(a) providing an apparatus for forming a bale, comprising:

(i) an upper platen comprising a convex protruding surface relative to the surface at the circumference of the upper platen for compressing an upper surface of the compressible cellulose acetate, wherein the protruding surface has a curved cross-sectional profile in the x-axis direction and the y-axis direction that is effective for forming a substantially flat upper surface on the compressible cellulose acetate;

(ii) a lower platen comprising a convex protruding surface relative to the surface at the circumference of the lower platen for compressing a lower surface of the compressible cellulose acetate, wherein the protruding surface has a curved cross-sectional profile in the x-axis direction and the y-axis direction that is effective for forming a substantially flat lower surface on the compressible cellulose acetate; and (iii) a rigid enclosure for accommodating the compressible cellulose acetate, wherein the enclosure comprises an upper opening enabling contact between the upper platen and the compressible cellulose acetate, and a lower opening enabling contact between the lower platen and the compressible cellulose acetate;

(b) providing the compressible cellulose acetate between the upper platen and the lower platen of the apparatus;

(c) compressing the compressible cellulose acetate between the upper platen and the lower platen by adjusting the position of the upper platen and/or the lower platen; and (d) covering the compressible cellulose acetate with a protective covering.

2. The method according to claim 1, wherein the protective covering comprises corrugated cardboard or woven polypropylene.

3. A method of forming a bale comprising a compressible cellulose acetate and having substantially flat upper and lower surfaces, comprising:

(a) providing an apparatus for forming a bale, comprising:

(i) an upper platen comprising a polyhedral protruding surface relative to the surface at the circumference of the upper platen for compressing an upper surface of the compressible cellulose acetate, wherein the protruding surface has a straight linear cross-sectional profile in the x-axis direction and the y-axis direction that is effective for forming a substantially flat upper surface on the compressible cellulose acetate;

(ii) a lower platen comprising a polyhedral protruding surface relative to the surface at the circumference of the lower platen for compressing a lower surface of the compressible cellulose acetate, wherein the protruding surface has a straight linear cross-sectional profile in the x-axis direction and the y-axis direction that is effective for forming a substantially flat lower surface on the compressible cellulose acetate; and (iii) a rigid enclosure for accommodating the compressible cellulose acetate, wherein the enclosure comprises an upper opening enabling contact between the upper platen and the compressible cellulose acetate, and a lower opening enabling contact between the lower platen and the compressible cellulose acetate;

(b) providing the compressible cellulose acetate between the upper platen and the lower platen of the apparatus;

(c) compressing the compressible cellulose acetate between the upper platen and the lower platen by adjusting the position of the upper platen and/or the lower platen; and (d) covering the compressible cellulose acetate with a protective covering.

4. The method according to claim 3, wherein the protective covering comprises corrugated cardboard or woven polypropylene.

5. The method according to claim 3, wherein the compressible cellulose acetate is compressed between the platens for up to 10 minutes.

6. The method according to claim 5, wherein the compressible cellulose acetate is retained in the apparatus for up to an additional 20 minutes.

7. The method according to claim 3, wherein the compressible cellulose acetate comprises cellulose acetate fiber.

* * * * *